US007778532B2

(12) United States Patent
Scherrer et al.

(10) Patent No.: US 7,778,532 B2
(45) Date of Patent: Aug. 17, 2010

(54) DEVICE FOR HEATING GROUNDS, IN PARTICULAR SPORTS GROUND

(75) Inventors: Jean-Marc Scherrer, Riedisheim (FR); Jean-Paul Scherrer, Brunstalt (FR); Jean-Claude Beisser, L'Argentière la Bessée (FR)

(73) Assignee: Brevetix, Kembs (FR)

( * ) Notice: Subject to any disclaimer, the term of this patent is extended or adjusted under 35 U.S.C. 154(b) by 663 days.

(21) Appl. No.: 11/660,791

(22) PCT Filed: Aug. 24, 2005

(86) PCT No.: PCT/FR2005/002131

§ 371 (c)(1),
(2), (4) Date: Mar. 14, 2007

(87) PCT Pub. No.: WO2006/024797

PCT Pub. Date: Mar. 9, 2006

(65) Prior Publication Data

US 2007/0269193 A1 Nov. 22, 2007

(30) Foreign Application Priority Data

Aug. 26, 2004 (FR) ..... 04 09107

(51) Int. Cl.
*A45D 20/40* (2006.01)

(52) U.S. Cl. ..... 392/407; 219/213

(58) Field of Classification Search ..... None
See application file for complete search history.

(56) References Cited

U.S. PATENT DOCUMENTS

| | | | |
|---|---|---|---|
| 4,839,500 | A | 6/1989 | Cremer et al. |
| 5,814,792 | A | 9/1998 | Wildi et al. |
| 5,854,472 | A | 12/1998 | Wildi et al. |
| 6,379,024 | B1 | 4/2002 | Kogure et al. |
| 2004/0004422 | A1 | 1/2004 | Claus et al. |

FOREIGN PATENT DOCUMENTS

| | | |
|---|---|---|
| EP | 0 517 929 | 12/1992 |
| WO | WO 93/19565 | 9/1993 |

*Primary Examiner*—Thor S Campbell
(74) *Attorney, Agent, or Firm*—Young & Thompson

(57) ABSTRACT

An installation for heating grounds, in particular sports grounds, using cables (9, 9', 9") supplied with electric current which are buried in the ground. The installation is characterized in that the surface of the grounds to be heated is divided into a number of sectors (1*a*, 1*b*, 1*c*, . . . , 1*n*), and each sector is heated by at least two heating lines (9, 9', 9") constituting each a secondary of a common transformer (3*a*, 3*b* et 3*c*).

20 Claims, 3 Drawing Sheets

DEVICE FOR HEATING GROUNDS, IN PARTICULAR SPORTS GROUND

BACKGROUND OF THE INVENTION

The present invention relates to a device for providing the heating of grounds and notably for keeping sports grounds frost-free.

DETAILED DESCRIPTION OF THE RELATED ART

Such heating devices are known and to do this, they resort to conducting cables which are buried in the ground and which are supplied with electric current via transformers which are placed in a plantroom neighbouring the ground to be heated. The latter is subdivided into several sectors dug with trenches in which the heating cables connected to the secondary circuit of the transformer are placed.

The devices for heating grounds of this type have a major drawback in that the electric power is transported from the transformer to the sector to be heated by power connections which, upon use, prove to be extremely costly in the amount of consumed power on the one hand, and in raw material cost on the other hand. Moreover, in this type of installation, all the sectors intended to be heated, do not have identical characteristics notably as regards their resistivity, so that if the intention is to bring them to a same temperature, specific heating power depending on these characteristics, will have to be distributed to them.

Finally, this type of installation should be totally faultless as regards electric safety.

SUMMARY OF THE INVENTION

The object of the present invention is thus to propose a device for providing the heating of grounds, and notably of sports grounds, with which the latter may be kept frost-free and this in a totally safe way as regards application of electric current, and by achieving notable savings on the other hand, both from the point of view of electric consumption and that of the cost of the implementation. The object of the present device is also to allow the power delivered by each transformer component to be adjusted with the area to be heated which corresponds to it.

The object of the present invention is thus an installation for heating a ground, notably a sports ground, by means of cables, supplied with electric current which are buried in the soil thereof, characterized in that the surface of the ground to be heated is divided into several sectors, and each sector is heated by at least two heating lines each forming a secondary of a same transformer.

The transformer will preferentially be of the torus type, and its secondary winding will be made in a metal with a lower conductivity than that of the heating lines, the secondary winding may thus be made in copper and the heating lines in aluminium. In this way, the diameter of the wire of the secondary winding and that of the heating line may thus have identical diameters which notably facilitate connection problems.

In order to maximally reduce the power lines, the transformers are placed in close proximity to the ground, preferentially in a technical gallery buried in the soil.

In a particularly interesting embodiment of the invention, the primary winding of the transformers will comprise a shield formed with metal sheet, preferentially consisting of aluminium or copper.

The cable forming the secondary winding of the transformer will advantageously be made in two conducting components twisted over each other.

BRIEF DESCRIPTION OF THE DRAWINGS

An embodiment of the present invention will be described hereafter as a non-limiting example, with reference to the appended drawing wherein.

DETAILED DESCRIPTION OF THE PREFERRED EMBODIMENTS

Figure 1:
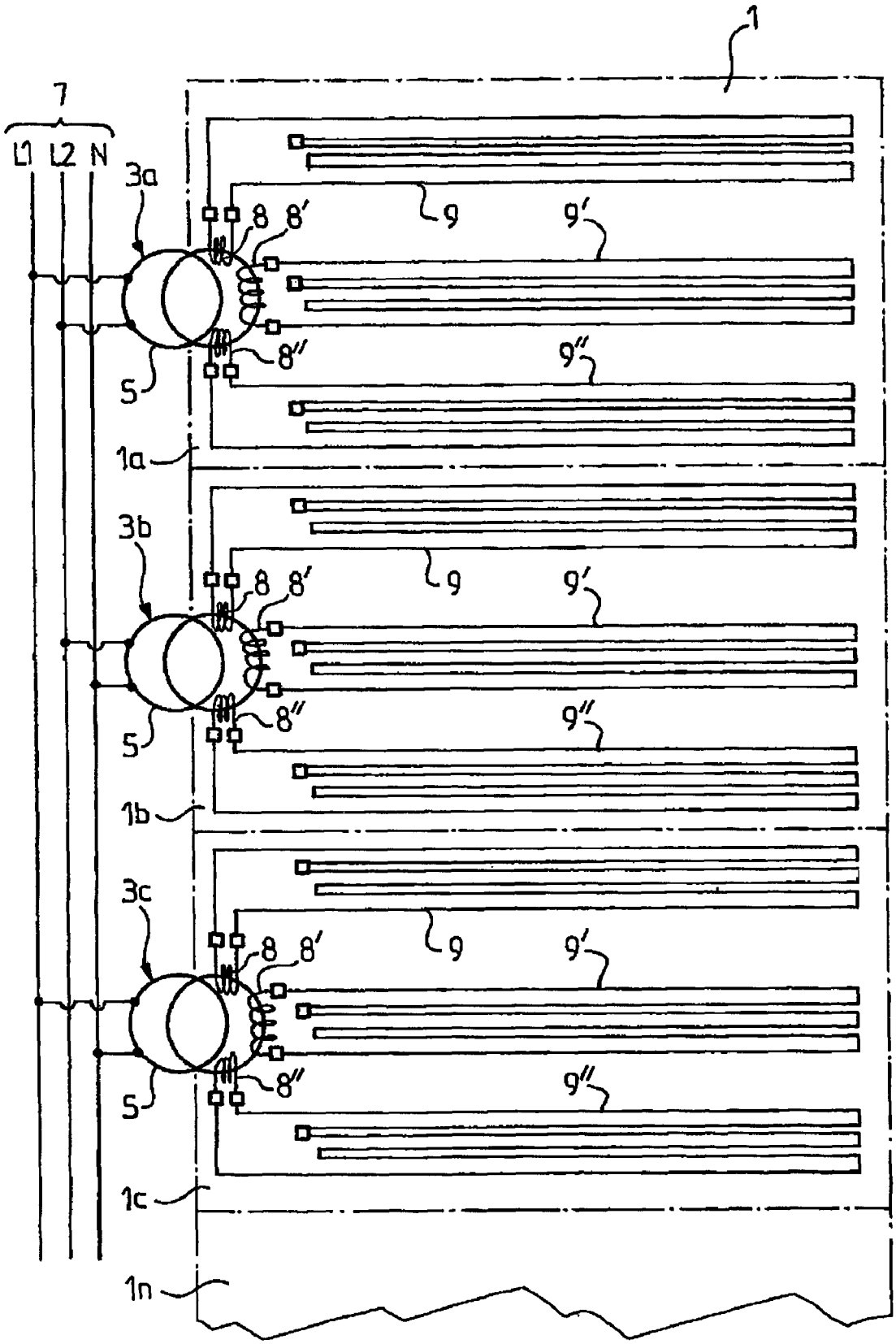
FIG. 1 is schematic view of a heating installation according to the invention.

A portion of a sports ground 1 which is divided in several sectors, i.e., sectors 1*a*, 1*b*, 1*c* which are intended to be heated so as to keep them frost-free, for example, is illustrated in FIG. 1.

The heating installation consists of a series of transformers 3*a*, 3*b*, 3*c*, . . . , 3*n* which are each associated with the heating of a determined ground sector 1*a*, 1*b*, 1*c*, . . . , 1*n*. A transformer thus for example, provides the power supply for three heating lines, 9, 9', 9" of a determined sector, these heating lines being buried into the soil of each of these sectors, and being either distributed uniformly or not in the space of the sectors, and this depending on the calorific needs of each of the latter.

More specifically, the primary 5 of each of these transformers is powered by a three-phase electric line 7 formed with two phase lines L1, L2 and a neutral line N. Conventionally, and in order not to unbalance the installation, the three primary windings of the transformers 3*a*, 3*b* and 3*c* are powered over lines L1-L2, L2-N and L1-N, respectively.

Each of the three heating lines 9, 9', 9" associated with a transformer 3*a*, 3*b*, 3*c*, . . . , 3*n* is respectively connected to a secondary winding 8, 8', 8" of the latter.

Figure 2:
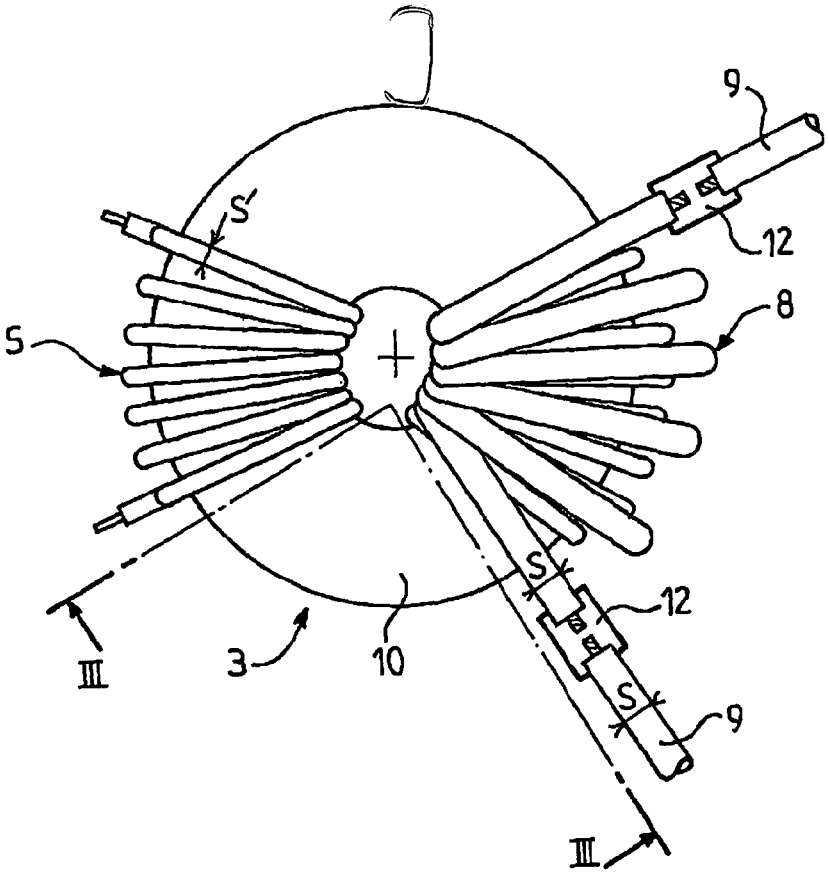
FIG. 2 is a top view of a transformer used in the installation according to the invention.
Figure 3:
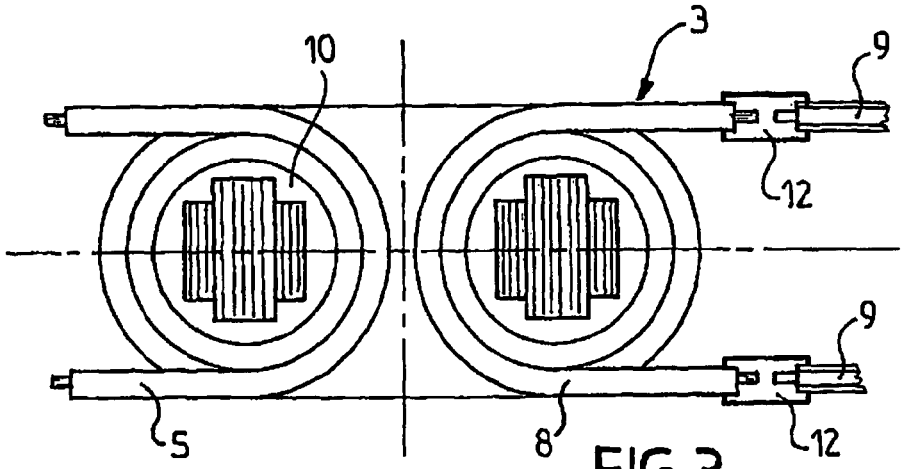
FIG. 3 is a sectional view of the transformer illustrated in FIG. 1, along the III-III line of the latter.

Such a transformer which essentially comprises a torus core 10 around which the primary winding 5 is wound and the three secondary windings 8, 8' and 8", is illustrated in FIGS. 2 and 3. (For more clarity in the drawing, only winding 8 was illustrated thereon). Each secondary winding consists of five turns which are made in a copper conductor and which are connected at each of their ends, via a connecting component 12, to an associated heating line 9, 9', 9", the length of which is such that it may cover a determined portion of the surface of the sector to be heated.

The primary winding 5, as for it, consists of a larger number of windings with a smaller diameter, the conducting wire used also consisting of copper. The conducting wire will advantageously include an electrostatic shield which will be integrated to it and which consists of a thin aluminium or copper sheet.

It is understood that depending on the environmental conditions, each of the sectors to be heated 1*a*, 1*b*, 1*c*, . . . , 1*n* is different from the sectors which are its neighbours, so that each of them will have to resort to a heating line 9, 9', 9" capable of delivering different power.

With the present invention, the user may precisely be given the possibility of adjusting, once on the ground, the power delivered by each secondary winding depending on the specific physical parameters of the soil to be heated and to its specific heating needs, and this by varying the voltage delivered by the latter. This power supply voltage may be controlled by varying the number of turns of each of the secondary windings.

Thus, it may be provided that an average power supply voltage will be obtained with a given number of turns (for example five), which will leave the user with the possibility of either suppressing one or two turns if the intention is to reduce the voltage, or add two turns if the intention is to increase it.

Figure 4:
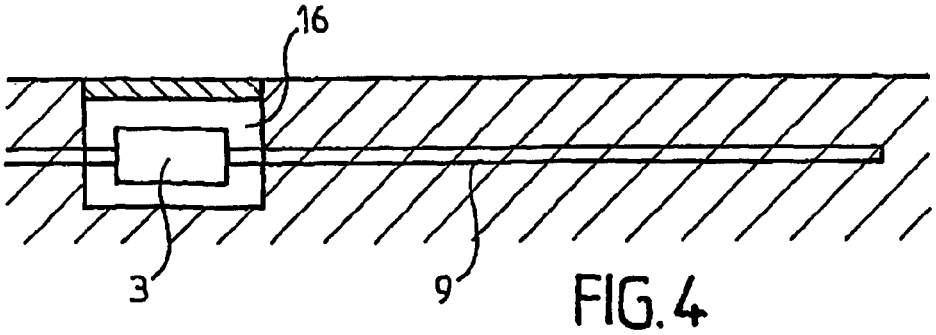
FIG. 4 is a schematic vertical sectional view showing the technical gallery adjacent to the ground to be heated.
Figure 5:
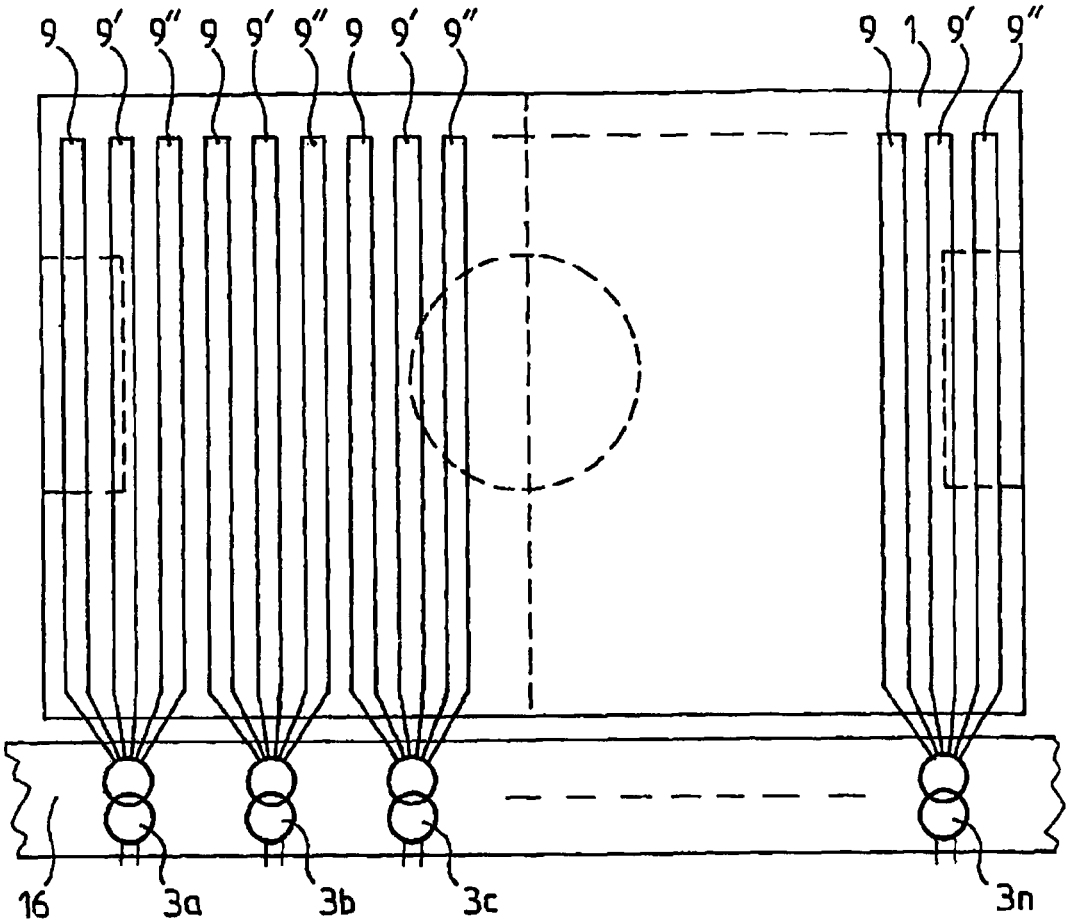
FIG. 5 is a schematic top view of a football pitch heated by the installation according to the invention.

Thus, as illustrated in FIG. 4, the transformers 3 may be placed in a technical gallery 16 for example made in a trench dug in the soil on the edge of the ground.

For this purpose, the transformers may be made totally sealed off by coating their magnetic circuit in a product for example consisting of resin.

In order to minimize the losses due to the Joule effect in the secondary of the transformers, the turns forming the secondary winding and the heating wires which are buried in the ground may be of different natures. It will thus be possible to make the turns of the secondary winding in a metal with very good electric conductivity which will maximally reduce the heating of the secondary of the transformer, and to make the turns forming the heating lines 9, 9', 9", in a metal with stronger resistivity.

In order to optimize the quality and the facility of connection between the turns of the secondary and the heating lines 9, 9', 9", these components will preferentially have identical diameters. It is therefore understood that the difference in resistance of both of these components will be due to the sole difference in resistivity between the respective materials selected for forming the turns of the secondary winding and the heating components. It was seen that by making the turns in copper and the heating cables in aluminium, a satisfactory conductivity ratio was obtained, allowing such a solution to be implemented. (The ratio of copper conductivity on that of aluminium is actually 1.6).

Preferentially, the heating cable will in fact be made in two components which will be twisted over each other so that it may avoid any formation of a magnetic field induced by these cables around the ground to be heated.

The output voltage of the secondary circuits of the transformers will be of the order of 40-50 volts, and the resistances formed by the heating lines 9, 9', 9" will be of the order of 0.5-0.8Ω, the power provided by the secondary circuit of each of the windings of the transformer then being of the order of 20 kVA.

Figure 6:
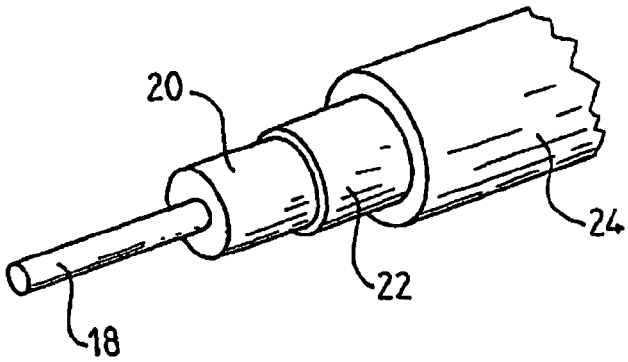
FIG. 6 is a cross-sectional view of a primary winding cable used in the installation according to the invention.

A conducting cable forming the primary of the transformer is illustrated as a cross-section in FIG. 6. It is seen that this primary conductor from the inside to the outside, consists of a conducting wire 18 in aluminium, of an insulating layer 20 for example consisting of polyvinylchloride, of a copper sheet 22 forming the shield, and finally an insulating and sealed-off external layer 24, for example in polyvinyl chloride.

As an example, it was established that the installation according to the invention was able to provide the heating of a sports ground of 6,000 $m^2$ under an external temperature of −10° C. and to keep it frost-free at a temperature of 5° C. To do this, a series of twenty four transformers is required, distributed along the ground in a buried technical gallery in the soil with a unit power of 20 kVA thereby delivering an overall voltage of 480 kVA. The secondaries of these transformers included five windings each delivering a power of 4 kVA and the resistances of the heating lines 9 were of the order of 0.6Ω.

The invention claimed is:

1. An installation for heating a ground, comprising:

plural transformers (3*a*, 3*b*, 3*c*), each transformer associated with a corresponding different one of plural ground sectors and comprising a primary side and a secondary side;

a common electric source (7, L1, L2, N) connected to the primary side of each of the plural transformers; and plural heating cable (9, 9', 9") sectors, each cable sector connected to the secondary side of a different one of the transformers, each cable sector buried in the soil of a different one of the ground sectors, each cable sector comprising three electrically separated heating cables, each of the three cables of each cable sector connected on the secondary side of the same transformer, as a different secondary of the same transformer and connected to a different secondary winding of the same transformer, wherein, the resistance formed by each cable (9, 9', 9") is of the order of 0.5-0.8Ω, the power provided by the secondary circuit of each the transformer is of the order of 20 kVA, and the secondary windings each transformer each delivers a power of 4 kVA.

2. An installation for heating a ground, comprising:

cables (9, 9', 9") supplied with electric current which are buried in the soil of the ground, wherein the cables are divided into plural cable sectors, each cable sector corresponding to a different one of plural ground sectors, each cable sector buried in the corresponding different one of the plural ground sectors (1*a*, 1*b*, 1*c*, . . . , 1*n*), and each ground sector is heated by the corresponding cable sector comprised of at least two different heating lines (9, 9', 9"), the at least two heating lines each forming a different secondary of a same transformer (3*a*, 3*b* and 3*c*).

3. The heating installation according to claim 1, wherein the transformer (3*a*, 3*b* and 3*c*) is of the torus type, its secondary winding being made in a metal with a lower conductivity than that of the heating lines (9, 9', 9").

4. The heating installation according to claim 3, wherein the secondary winding is made in copper and the heating lines (9, 9', 9") are made in aluminum.

5. The heating installation according to claim 4, wherein the diameters of the secondary winding and of the heating lines (9, 9', 9") are substantially identical.

6. The heating installation according to claim 1, wherein the transformers (3*a*, 3*b* and 3*c*) are placed in close proximity to the ground.

7. The heating installation according to claim 6, wherein the transformers (3*a*, 3*b* and 3*c*) are placed in a technical gallery (16) buried in the soil.

8. The heating installation according to claim 1, wherein the primary winding (5) of the transformers (3*a*, 3*b* and 3*c*) comprise a shield consisting of a metal sheet (22).

9. The heating installation according to claim 1, wherein the cable forming the secondary winding of the transformer is made in two conducting components twisted over each other.

10. The heating installation according to claim 1, wherein the open circuit voltage of the secondary of the transformer (3*a*, 3*b* and 3*c*) is of the order of 50 volts.

11. The heating installation according to claim 1, wherein the magnetic circuit of the transformer is insulated.

12. The installation for heating a ground, according to claim 1, wherein the ground is a sports ground.

13. The heating installation according to claim 1, wherein the magnetic circuit of the transformer is insulated by means of a resin.

14. An installation for heating a ground, comprising:

a ground (1) divided into plural different ground sectors (1*a*, l*b*, 1*c*);

plural transformers (3*a*, 3*b* and 3*c*) , each transformer associated with a corresponding different one of the ground sectors and comprising a primary side and a secondary side;

a common electric source (7, L1, L2, N) connected to the primary side of each of the plural transformers; and plural heating cable (9, 9', 9") sectors, each cable sector connected to the secondary side of a different one of the transformers and buried in the soil of a different one of the ground sectors, each cable sector comprising three electrically separated heating cables, the three cables each connected to the secondary side of the same transformer as a different secondary of the same transformer and to a different secondary winding (8, 8', 8") of the same transformer, each of the three cables buried in the same ground sector, each of the three cables heating a different portion of the same ground sector.

15. The heating installation according to claim 14, wherein, each ground sector defines a rectangular surface area, a first cable of each cable sector is buried along a first edge of the corresponding surface area and heats an area along the first edge of the corresponding surface area, a second cable of each cable sector is buried along a center portion of the corresponding surface area and heats an area of the center portion of the corresponding surface area, and a third cable of each cable sector is buried along a second edge of the corresponding surface area and heats an area along the second edge of the corresponding surface area.

16. The heating installation according to claim 14, wherein, a common electric source (7, L1, L2, N) connected to the primary side of each of the plural transformers is a three-phase electric line (7).

17. The heating installation according to claim 16, wherein, each transformer comprises a torus core (10) with a primary winding (5) and three secondary windings (8, 8', 8"), each secondary winding has five turns, each secondary winding made is a copper conductor;

a connecting component (12) located between each secondary winding and each end of the cable connected to the secondary side of the transformer, the primary side of each transformer comprising a primary winding of a greater number of turns than a number of turns of the secondary winding and of a smaller diameter than a diameter of the secondary winding, the primary winding made in a copper conductor, and each of the cables of the cables sectors is made of aluminum.

18. The heating installation according to claim 17, wherein the shield consists of aluminum or copper.

19. The heating installation according to claim 17, wherein the magnetic circuit of the transformer is insulated by means of a resin.

20. The heating installation according to claim 17, wherein, the resistance formed by each cable (9, 9', 9") is of the order of 0.5-0.8Ω, the power provided by the secondary circuit of each the transformer is of the order of 20 kVA, and the secondary windings each transformer each delivers a power of 4 kVA.

* * * * *